United States Patent [19]

Leung

[11] Patent Number: 5,033,200

[45] Date of Patent: Jul. 23, 1991

[54] SCIENTIFIC RULER

[76] Inventor: Yee T. Leung, No. 8, 4F., Mansfield Industrial Centre, Hong Yip Str., Yuen Long, N.T., Hong Kong

[21] Appl. No.: 567,283

[22] Filed: Aug. 14, 1990

[51] Int. Cl.[5] ..... B43L 7/00

[52] U.S. Cl. ..... 33/485; 33/488; 33/492; 33/564; 33/354; 350/243

[58] Field of Search ..... 33/272, 348, 354, 403, 33/483–494, 562, 563, 564, 565; 350/243, 453, 245

[56] References Cited

U.S. PATENT DOCUMENTS

| | | | |
|---|---|---|---|
| 373,597 | 11/1887 | McMicken | 33/485 |
| 708,355 | 9/1902 | Harney | 33/485 |
| 911,483 | 2/1909 | Faehrmann | 350/243 |
| 1,498,485 | 6/1924 | Schmidtke | 33/484 |
| 1,583,138 | 5/1926 | Garnett | 33/565 |
| 1,840,135 | 1/1932 | Schutt | 350/243 |
| 2,736,097 | 2/1956 | Coleman, Jr. | 33/488 |
| 4,770,519 | 9/1988 | Jacques | 350/243 |

*Primary Examiner*—Thomas B. Will

[57] ABSTRACT

The present invention relates to a scientific ruler incorporated with a concave lens and a convex lens which may be dismantled from the ruler and aligned with each other to compose as a telescope. The concave lens or convex lens may be replaced by a compass. A protractor is provided around the periphery of the concave lens. An inclined plane is formed at either one or both ends of the ruler capable of refracting the sunlight into a rainbow spectrum. Further, a comb and a thermometer are provided. In addition to various mathematic and equal signs and undulate edge there are more space area for indicating name of the user and adhering stickers.

9 Claims, 5 Drawing Sheets

SCIENTIFIC RULER

BACKGROUND OF THE INVENTION

This invention relates to a scientific ruler, particularly to a scientific ruler having multiple functions for practical use and educational purposes.

Conventionally, the ruler is marked with metric and British scales on respective sides. Except for measuring the length and drawing the line a general ruler has no other function. In view of this a kind of functional ruler is provided with stencil holes having various geometric shapes such as square, circular, triangle and the like, as well as various symbols, such as plus, minus, multiplication and division signs. But there are no practical scientific rulers for enhancing educational effect so far.

SUMMARY OF THE INVENTION

The primary object of this invention is to provide a novel scientific ruler with concave and convex lenses, in addition to the application as lenses themselves, either or both of which may be dismantled from the ruler and aligned with each other to compose as a telescope without a conventional telescopic cylinder.

It is still another object to provide an aforementioned ruler in which a compass may be disposed in place of the concave lens or convex lens.

It is still another object to provide an aforementioned ruler which, in addition to the conventional metric and British scales on opposite lateral sides, may be formed with a protractor having an angular scale at the perimeter of the concave lens.

It is still another object to provide an aforementioned ruler which includes a comb having a plurality of teeth of different lengths arranged in sequence which, in addition to its usefullness as a conventional comb, may be played to sound the tones in different frequencies when the user strikes the ends of the teeth.

It is an additional object to provide an aforementioned ruler which, in addition to the stencil holes of vertical, horizontal, inclined and division symbols for the expression of plus, minus, multiplication and division signs, may be formed with a number of rectangular blanks for the expression of various equal signs as well as an undulate edge.

It is a further object to provide an aforementioned ruler further including a thermometer and formed with an inclined plane at either one or both ends to act as a prism.

It is still a further object to provide an aforementioned ruler which has additional spare areas for adhering the labels marked with the name of the user or his favorable patterns or stickers.

BRIEF DESCRIPTION OF THE DRAWINGS

The aforementioned and other objects, features and advantages shall be more understood from the following detailed description of the preferred embodiments with reference to the accompanying drawings in which.

DETAILED DESCRIPTION OF THE PREFERRED EMBODIMENTS

Figure 1:
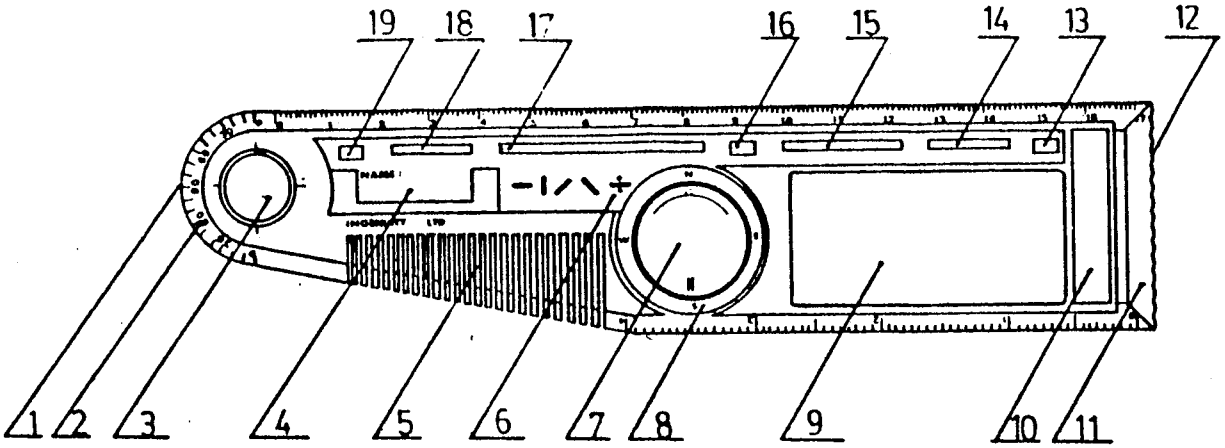
FIG. 1 is a top plane view of one embodiment of the scientific ruler according to present invention.
Figure 2:
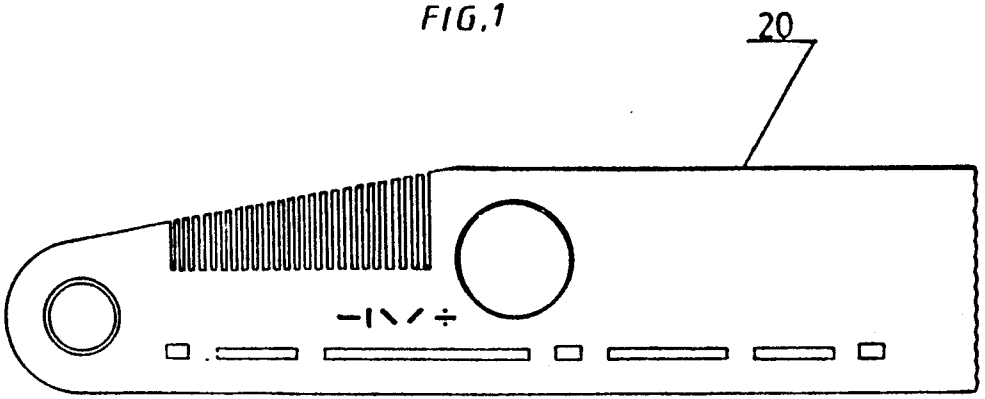
FIG. 2 is a bottom plane view of FIG. 1.

Now, with reference to FIG. 1 of the drawings the scientific ruler according to the present invention comprises a protractor 1 with an inclined plane 2, a concave lens 3, a marking area 4 for indicating the name of the user, a comb 5, a plurality of stencil holes 6 of vertical, horizontal, inclined and division symbols for the expression of plus, minus, multiplication and division signs, a convex lens 7, a plurality of marking symbols 8 around the convex lens indicating the directions toward east, west, south and north by respective abbreviation such as E, W, S and N, a spare area 9 for stickers, a thermometer 10 (not shown), an inclined plane 11 at one side of the ruler where an undulate edge 12 is provided and a plurality of rectangular blanks 13–19 for the expression of various equal signs in different lengths and intervals. Moreover, a stepped or recessed edge 20 is designed as shown in FIG. 2 to permit the user to more easily pick up the ruler from a plane surface. The ruler is certainly marked with metric and British scales on respective sides as shown in FIG. 1, as usual.

Figure 3:
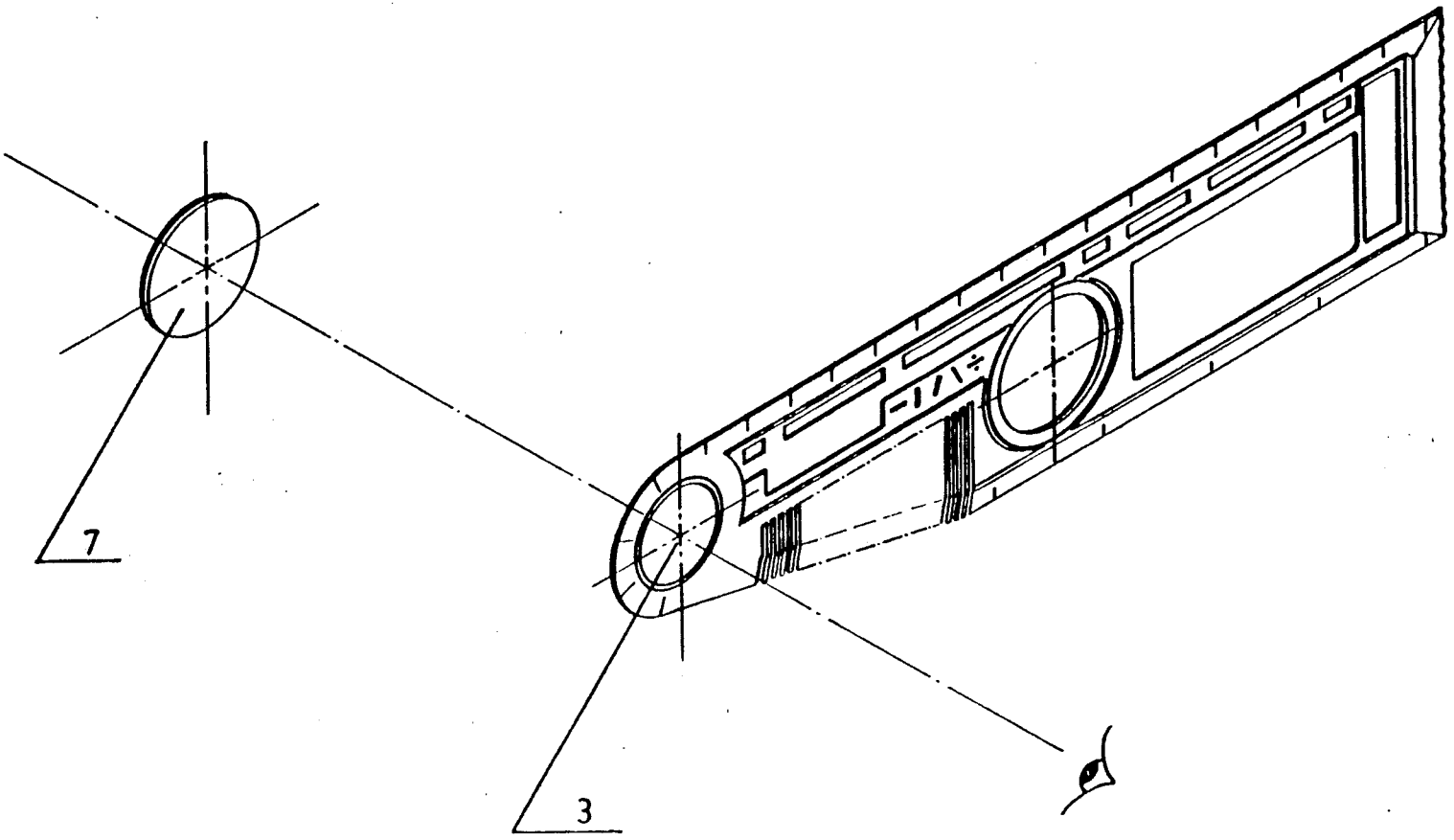
FIG. 3 is an illustration schematically depicting the convex lens being dismantled from the ruler and aligned with the concave lens on the ruler to compose a telescope.
Figure 4:
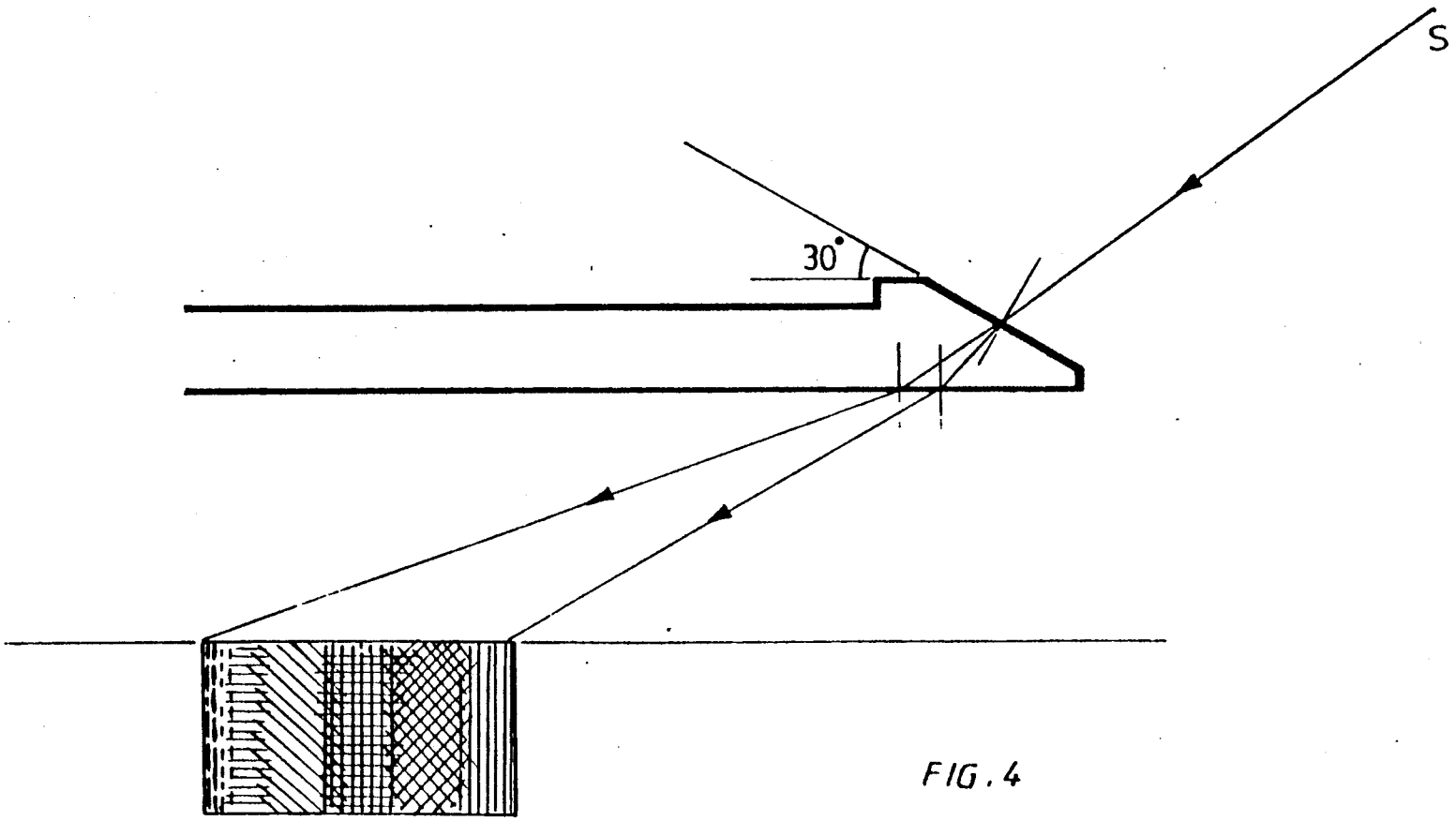
FIG. 4 is an illustration depicting the rainbow spectrum refracted from the inclined plane at one end of the ruler where the undulate edge is provided.
Figure 5:
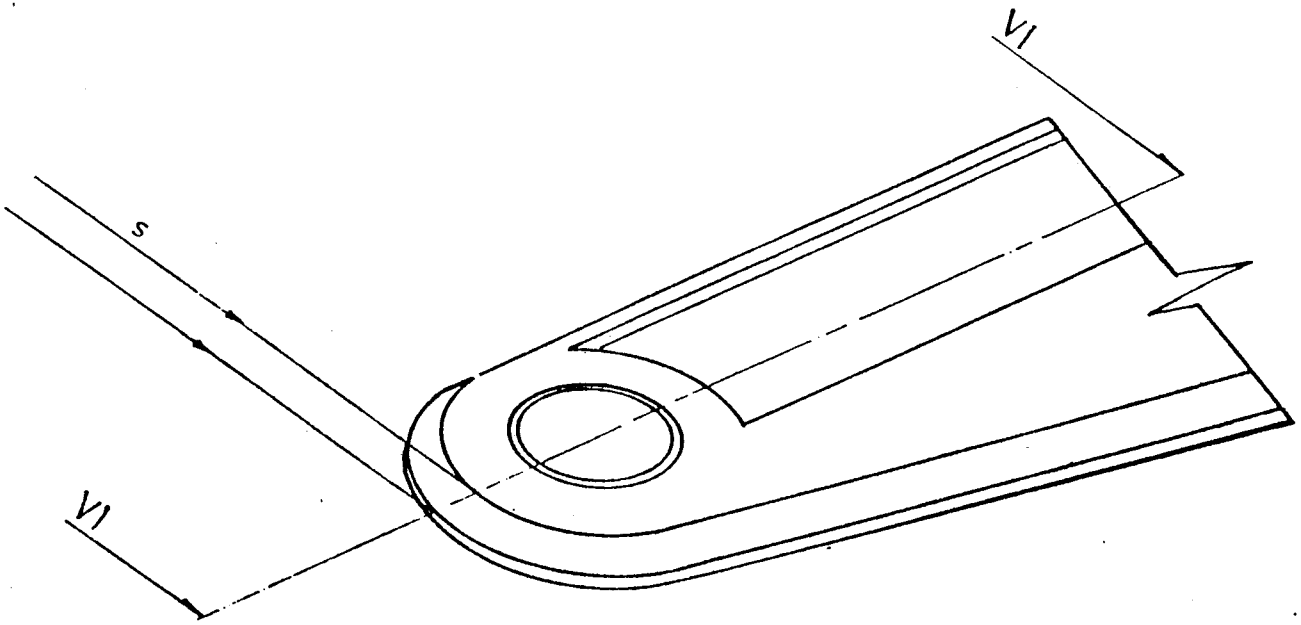
FIG. 5 is an illustration depicting the rainbow spectrum refracted from the inclined plane at another end of the ruler where the protractor is provided.

Either one or both of the concave lens 3 and convex lens 7 may be removable. For instance, an annular groove may be formed on respective lens 3 and 7 for snapping the same at the inner periphery of the respective preserved circular openings on the ruler for said lenses. As shown in FIG. 3, the convex lens 7 is dismantled from the ruler and aligned with the concave lens 3 on the ruler to act as a telescope. Of course, the concave lens 3 can be fixed or optionally dismantled from the ruler too. Naturally, the concave and convex lenses 3, 7 each have the usual function of lenses.

There is no telescopic cylinder provided since those lenses 3,7 are not designed particularly for a telescope, but the principle of a telescope may be utilized as desired. This provision is not found in any conventional ruler and can be used as an optical educational instrument. Although not shown, it is understood that the area around the concave lens 3, just as around the convex lens 7, may be marked with the symbols of direction, such as E, W, S and N, toward east, west, south and north.

The protractor 1 is provided at the periphery of the concave lens 3 in the shape of half a circle with a scale. If one reading on the scale represents an angle of ten degrees, then the whole scale on the protractor 1 covers an arc in total of 180 degrees. The method of measuring the angle is carried out on the basis of the cross coordinates arround the periphery of the concave lens 3.

In the embodiment as shown, the comb 5 is provided at the inclined section of one lateral side in the region between said concave lens 3 and convex lens 7 to have a plurality of teeth in different lengths. As clearly shown in FIG. 1 the length of the teeth decreases sequentially from the side in the vicinity of convex lens 7 to the side toward the concave lens. Since the length of the teeth, i.e. the distance from the distal ends to the proximal ends of the teeth are varied among the teeth of the comb 5, when the distal ends of different teeth are played or striked, the audio frequences generated by the elastic force of reaction, in other words, the levels of tone are varied accordingly. So that this comb 5 may be used as an acoustic educational instrument, in addition to the function of a conventional comb itself.

The ruler at one end has an undulate edge 12 which is formed with an inclined plane 11 at an inclination with respect to the horizontal bottom plane in the range of 25° to 45°, and preferably about 30°. The sunlight S, as soon as it reflects onto the inclined plane 11, is analyzed in seven colors by the prismatic action and refracted onto a plane surface to appear as a rainbow spectrum. In a similar manner, at another end of the ruler a protractor 1 is provided which may also be formed with an inclined plane 2 at a similar inclination with respect to the horizontal bottom plane in the range of 25° to 45°, and preferably about 30°. Since the inclined plane 2 has a semi-circular periphery, the projected rainbow spectrum is also in the shape of half a circle. This design is also suitable for use as an optical educational instrument.

Figure 6:
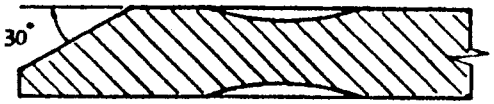
FIG. 6 is a cross section taken along the line VI—VI of FIG. 5.

FIG. 6 shows the inclined plane in an inclination of 30° and the concave lens in fixed type. When the ruler is made of acrylic material the concave lens may be integrally formed with the ruler rather than removably attached on it.

Figure 7:
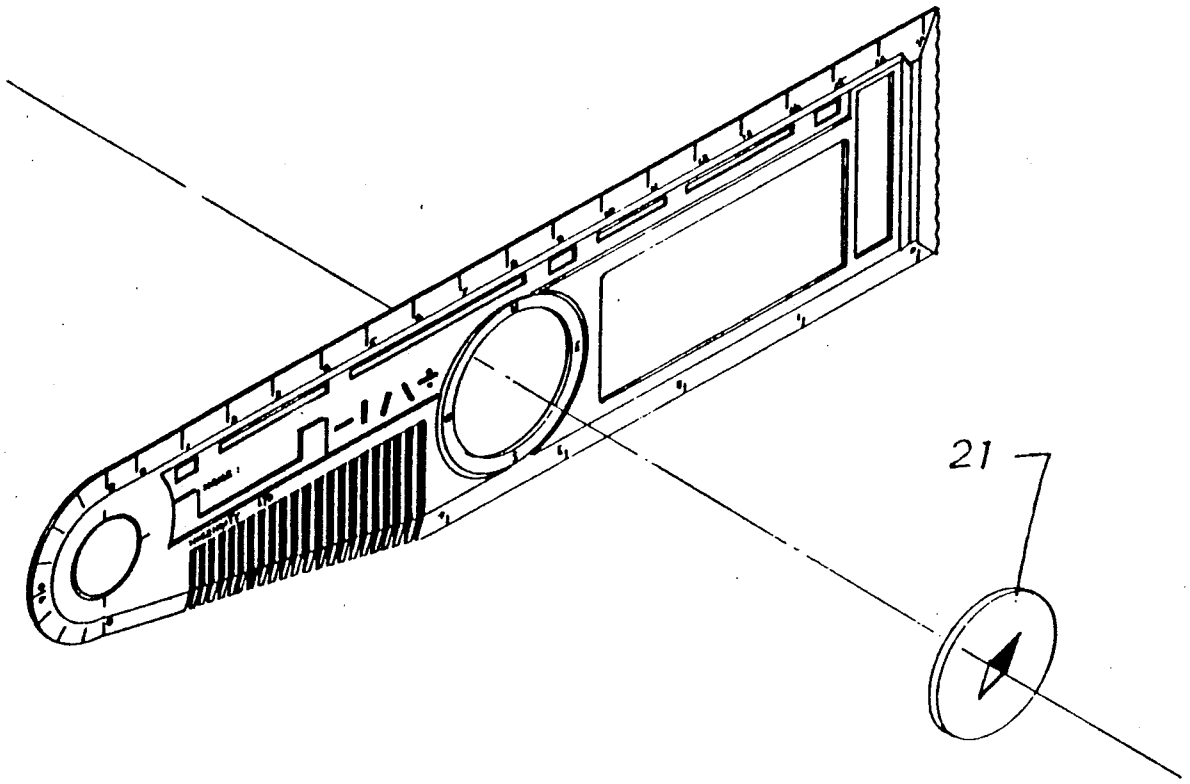
FIG. 7 is a perspective view depicting a compass in place of the convex lens as shown in FIG. 1.

FIG. 7 shows that the convex lens may be replaced by a compass 21. Of course the concave lens as a removable type may also be replaced by a compass as desired.

As mentioned above, the scientific ruler according to the present invention is not shown in the state of art and has multiple practical functions, is especially good for educational purposes in particular for stimulating the increasing learning interest of children.

It should be understood, however, that the foregoing invention is intended merely to be illustrative thereof and that other embodiments and modifications may be apparent to those skilled in the art without departing from its spirit.

What I claim is:

1. A scientific ruler marked with metric and British scales on opposite lateral sides, comprising:

a concave lens having a periphery and a convex lens, disposed within and at least one of which may be dismantled from said ruler and aligned to each other to compose a telescope;

an undulate edge at one side of said ruler;

a protractor disposed at another side of said ruler around the periphery of said concave lens forming a semi-circular arc;

a comb including a plurality of teeth of different lengths arranged in sequence, said comb being located on another side of the ruler in a region between said concave lens and said convex lens; and a plurality of stencil holes shaped of various symbols for the expression of plus, minus, multiplication and division sign, as well as various equal signs of different lengths and intervals in said ruler.

2. The ruler according to claim 1, wherein said protractor is marked with an angular scale wherein each reading represents ten angular degrees on the basis of cross coordinates disposed around the periphery of said concave lens.

3. The ruler according to claim 1, wherein said concave lens is marked at its periphery with symbols indicating east, west, south and north directions.

4. The ruler according to claim 1, wherein said convex lens is marked at its periphery with symbols indicating east, west, south and north directions.

5. The ruler according to claim 1, wherein said ruler has a horizontal bottom plane and said undulate edge is formed with an inclined plane at an inclination with respect to the horizontal bottom plane in the range of 25° to 45°.

6. The ruler according to claim 1, wherein said ruler has a horizontal bottom plane and said protractor is formed with an inclined plane at an inclination with respect to the horizontal bottom plane in the range of 25° to 45°.

7. The ruler according to claim 1, wherein said ruler further includes a thermometer disposed thereon.

8. The ruler according to claim 1, wherein a compass is provided in place of said concave lens.

9. The ruler according to claim 1, wherein a compass is provided in place of said convex lens.

* * * * *